United States Patent [19]

Murakami et al.

[11] Patent Number: 4,492,552

[45] Date of Patent: Jan. 8, 1985

[54] APPARATUS FOR SLIDE FORMING OF PRESTRESSED CONCRETE

[75] Inventors: Yoshihiko Murakami, Tsukushino; Noboru Ohta, Fukuoka, both of Japan

[73] Assignee: Fuji P.S. Concrete Co., Ltd., Fukuoka, Japan

[21] Appl. No.: 373,800

[22] Filed: Apr. 30, 1982

[30] Foreign Application Priority Data

May 1, 1981 [JP] Japan ..... 56-65188
May 6, 1981 [JP] Japan ..... 56-66893
May 21, 1981 [JP] Japan ..... 56-75638

[51] Int. Cl.[3] ..... B28B 7/02

[52] U.S. Cl. ..... 425/218; 264/70; 264/228; 425/88; 425/111; 425/117; 425/432

[58] Field of Search ..... 425/111, 432, 427, 88, 425/64, 218, 219, 117; 264/228, 70; 52/230, 228, 227

[56] References Cited

U.S. PATENT DOCUMENTS

| | | | |
|---|---|---|---|
| 3,089,215 | 5/1963 | Stubbs | 425/111 |
| 3,123,872 | 3/1964 | Perlmutter et al. | 425/432 X |
| 3,181,222 | 5/1965 | Palmer | 425/111 |
| 3,200,177 | 8/1965 | Dodd | 264/70 |
| 3,274,906 | 9/1966 | Worson et al. | 264/70 |
| 3,528,144 | 9/1970 | Haponski | 425/432 |
| 3,566,490 | 3/1971 | Nagy | 264/70 X |
| 3,732,052 | 5/1973 | Gunia | 425/432 X |
| 3,836,354 | 9/1974 | Wienart | 264/70 X |
| 3,877,860 | 4/1975 | Putti | 425/64 |
| 3,938,922 | 2/1976 | Godley | 425/111 |
| 3,967,421 | 7/1976 | Dufossez | 52/230 X |
| 4,051,216 | 9/1977 | Bratchell | 425/111 X |
| 4,090,827 | 5/1978 | Attwell | 425/219 |
| 4,229,153 | 10/1980 | Hight, Jr. | 425/64 |
| 4,369,153 | 1/1983 | Nash et al. | 425/64 |

FOREIGN PATENT DOCUMENTS 55-41218 3/1980 Japan .

*Primary Examiner*—Jay H. Woo
*Assistant Examiner*—James C. Housel
*Attorney, Agent, or Firm*—Schwartz & Weinrieb

[57] ABSTRACT

A combination long lower mold and pretension bench for the formation of prestressed concrete materials is constructed by serially connecting plurality of unit lower molds of concrete, attaching prestressing steel wire tension benches one each to the foremost and rearmost unit lower molds, and fastening the unit lower molds and the tension benches collectively with steel wires. Prestressed concrete materials are obtained by stretching prestressing steel wires along the upper surface of the long lower mold, continuously pouring and placing stiff-consistency concrete on the long lower mold, causing a slide upper mold to run on the concrete thereby shaping the concrete in a required cross section, curing the shaped concrete strip, and cutting the cured concrete strip into pieces of a desired size.

11 Claims, 32 Drawing Figures

APPARATUS FOR SLIDE FORMING OF PRESTRESSED CONCRETE

FIELD OF THE INVENTION

This invention relates to a method for the slide forming of prestressed concrete materials and to an apparatus therefor.

BACKGROUND OF THE INVENTION

It is known to the art to produce shaped concrete materials by advancing concrete molding frames, feeding stiff-consistency concrete to the molding frames in motion, shaping the concrete in a required cross section, and discharging the shaped concrete pieces backwardly from the molding frames still in motion. This method, however, requires large, expensive facilities.

The inventors developed an apparatus for forming a strip of prestressed concrete material by causing a short upper mold to move on concrete placed in advance in a long lower mold. A patent application covering this invention was filed with Japanese Patent Office and has already been disclosed under Japanese patent application Disclosure No. 41218/1980. This apparatus makes use of one sliding upper frame which is provided with a scraper for smoothing concrete and an upper mold and which is adapted to be advanced while being shaken in its entirety. This apparatus is effective in forming flat concrete plates but is hardly suitable for forming concrete plates incorporating reinforcing ribs.

When stiff-consistency concrete is placed and set in an ordinary molding frame, it is exposed to vibration and pressure for as much time as is required. In the slide forming operation which is required to compress concrete to a required cross section simply by passing the upper mold, it is thought hardly practicable to place concrete uniformly in the thin plate portion and the thick rib portion. Hopes have nevertheless been entertained that this trouble might be solved by making improvements in the upper frame side.

The method for covering the lower mold of concrete with metal plates accurately and efficiently has remained to be perfected. The construction of rails for guiding the vibrating upper frame, the method for curing a strip of concrete product, and the method for cutting this strip into pieces of a desired size have room for further refinement.

OBJECTS OF THE INVENTION

A primary object of this invention is to provide a substantial improvement of the slide forming method which obtains prestressed concrete materials of a required cross section by running the upper mold on the long lower mold.

Another object of this invention is to provide a slide forming apparatus which is capable of forming a strip of concrete material having a fixed cross section uniformly throughout the entire length thereof by simply passing a short upper frame on a stiff-consistency concrete placed in advance on a long lower mold.

Yet another object of this invention is to provide a slide forming apparatus which can be readily adapted to a change in the height of reinforcing ribs used in the concrete products being produced.

A further object of this invention is to provide a slide forming apparatus which can be readily adapted to a change in the length of the concrete products being produced.

Still another object of this invention is to provide unit lower molds for the slide forming apparatus which are easily fabricated and assembled and do not permit leakage of the steam used for curing.

Another object of this invention is to provide a concrete surface finishing unit advantageous for use in the slide forming apparatus.

A further object of this invention is to provide improved sliding rails advantageous for use in the slide forming apparatus.

Yet another object of this invention is to provide a method for enabling the concrete which has undergone the slide forming on the lower mold to be cured in its unaltered form.

Still another object of this invention is to provide prestressed concrete materials having ribs raised in the central portion above the surface of the opposite end portions, which are readily produced by the slide forming.

A further object of this invention is to provide a method for the manufacture of a lower mold covered with a steel plate and used for the slide molding, which lower mold is easily obtained by this method with high dimensional accuracy.

SUMMARY OF THE INVENTION

To accomplish the objects described above according to the present invention, there is provided a method for the slide forming of plate-shaped prestressed concrete materials having varying cross sections, which method comprises constructing a pretension bench by serially arranging as many unit lower molds of concrete as necessary for completing a long lower mold of a desired length, said unit lower molds being each provided with a concrete placing surface covered with a metal plate and further provided on the lateral edges thereof with rails for running an upper frame, connecting prestressing steel wire tension benches one each to the forward and rearward ends of the long lower mold, and tying the long lower mold and the tension benches collectively with steel wires or steel rods, stretching prestressing steel wires along the upper surface of the aforementioned long lower mold, pouring and placing stiff-consistency concrete on the long lower mold, causing a slide forming upper frame which is provided on the common base with a height regulating unit to pass only the portion of the stiff-consistency concrete on the long lower mold which lies below required heights at varying positions, then causing vibration guide plates disposed at various heights at various positions of the aforementioned vibrating units to vibrate and press the concrete while guiding it forward, and causing an upper mold of the subsequent aforementioned shaping unit which is provided with an exclusive vibrator to finish the concrete in a required shape.

According to the method of this invention, the long concrete forming frame which is required for the slide forming is produced by combining a multiplicity of short unit molds and pretension devices. The frame, therefore, is easily constructed and can be moved when necessary. When the unit molds and the attendant devices are transported to and assembled at a construction site requiring a large number of prestressed concrete materials, the resulting long concrete forming frame can be used for mass producing such prestressed concrete materials at the point of use. Consequently, the cost for storage and transportion of finished products can be cut to a great extent.

Since the unit molds are made of concrete and covered with a metal plate, they excel in resistance to vibration, durability and retention of dimensional accuracy. By passing steam inside the molds and covering the upper surface of the produced concrete material with the steam, curing at an ideal temperature gradient can be realized in place.

The conventional slide forming method is not capable of exerting ample vibration and pressure upon the concrete as effected by the method which handles stiff-consistency concrete in an ordinary mold. In contrast, the slide forming method of the present invention not merely runs the upper mold but causes the height regulating unit and the vibrating unit to run in front of the upper mold and enables the guide vibration plates to impart ample vibration to the concrete and give to the concrete the thickness distribution required of the product, and forward the concrete to the desired position in the upper mold. The concrete thus forwarded to the upper mold is rich in active force and gives rise to a product which enjoys uniform consistency and high dimensional accuracy.

BRIEF DESCRIPTION OF THE DRAWING

Various other objects, features, and attendant advantages of the present invention will be more fully appreciated as the same becomes better understood from the following detailed description, when considered in connection with the accompanying drawings in which like reference characters designated like or corresponding parts throughout the several views, and wherein.

DESCRIPTION OF PREFERRED EMBODIMENT

Figure 1:
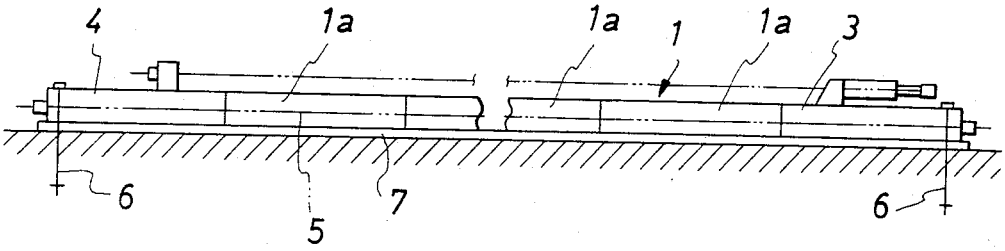
FIG. 1 is an elevation of an embodiment of the combination long lower mold and pretension bench according to the present invention.
Figure 2:
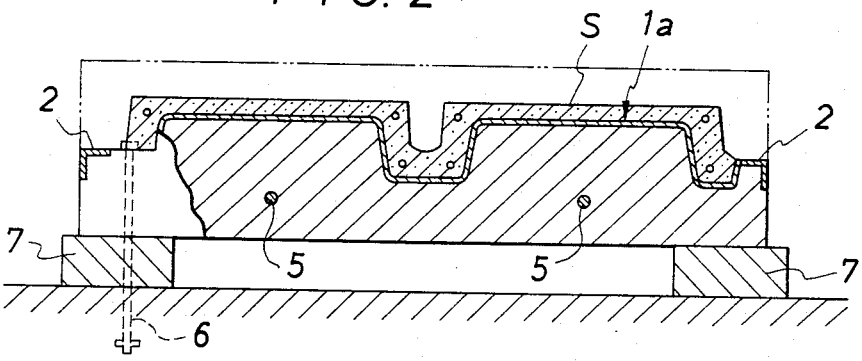
FIG. 2 is a cross section of the embodiment of FIG. 1.

FIGS. 1, 2 represent one embodiment of the combination long lower mold and pretension bench 1 of the present invention. It serves as a lower mold for giving the shape of a lower surface to plate-shaped prestressed concrete materials of varying cross sections and also serves as a device for stretching pretension steel wires along the upper surface of the long lower mold. The length of the long lower mold frequently reaches more than 100 m. The long lower mold, therefore, is obtained by serially connecting as many unit lower molds 1*a* about 3 m in length as necessary to reach the total length called for and then connecting prestressing steel wire tension bases 3, 4 one each to the foremost and rearmost unit lower molds. The unit lower molds 1*a* are each provided along the longitudinal edges thereof with rails 2. The unit lower molds and the tension bases thus arranged serially are collectively fastened with steel wires or steel rods 5.

Since the unit lower molds 1*a* are made of concrete and, therefore, are strong enough to withstand shrinkage, they constitute excellent components for a pretension bench. Since they are less susceptible of deformation than a molding frame formed by assembling steel plates, they also constitute excellent components for a slide forming lower mold. The upper surface of the unit lower mold 1*a* is covered with a metal plate and is used for the placement of concrete.

Figure 3:
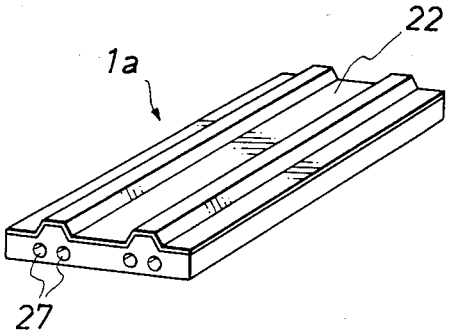
FIG. 3 is a perspective view of one embodiment of the unit lower mold.
Figure 4:
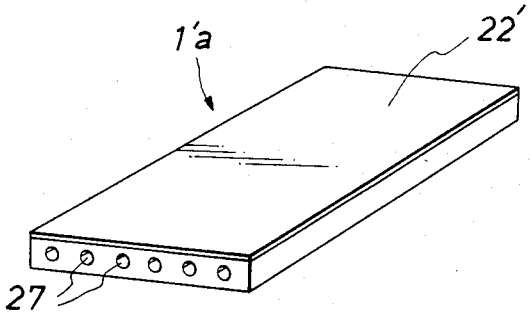
FIG. 4 is a perspective view of another embodiment of the unit lower mold.

FIGS. 3, 4 represent two typical unit lower molds for use in this invention. The unit lower mold of FIG. 3 is used for the production of prestressed concrete materials having a wavy cross section indicated by S in FIG. 2. The unit lower mold of FIG. 4 is used for the production of prestressed concrete materials having a flat lower surface as concrete materials S' containing ribs R illustrated in FIG. 7. In the unit lower molds indicated above, the upper surfaces of the concrete materials are covered with upper surface plates 22, 22'. Denoted by 27 are steam vents which play their part during the curing of concrete as described more fully later.

In the present embodiment, parallel support stands 7 are placed as illustrated in FIGS. 1, 2. On these support stands, the aforementioned combination long lower mold and pretension bench is assembled and the opposite ends of the lower mold are fastened with anchor bolts 6. An upper frame which travels on the long lower mold 1 is indicated by a dotted line in FIG. 2. This will be described in detail with reference to FIG. 5 and the following figures.

FIGS. 5–10 represent another long lower mold 1' constructed as described above and an upper frame 8 to be mounted on the long lower mold 1'. Prestressing steel wires 9 are stretched along the upper surface of the long lower mold 1' and stiff-consistency concrete C is continuously poured and placed on the long lower mold 1'. Then the upper frame 8 for slide forming is driven on the rails 2. The driving of the upper frame 8 is effected by traction with a winch not shown in the diagram. The upper frame 8 is provided with a height regulating unit 11, a vibrating unit 12, and a shaping unit 13 which are mounted on a common base **8*a* through the medium of shock-absorbing members 8*b*. These units are respectively provided with exclusive vibrators 14, 14*a*, and 14*b***.

Figure 6:
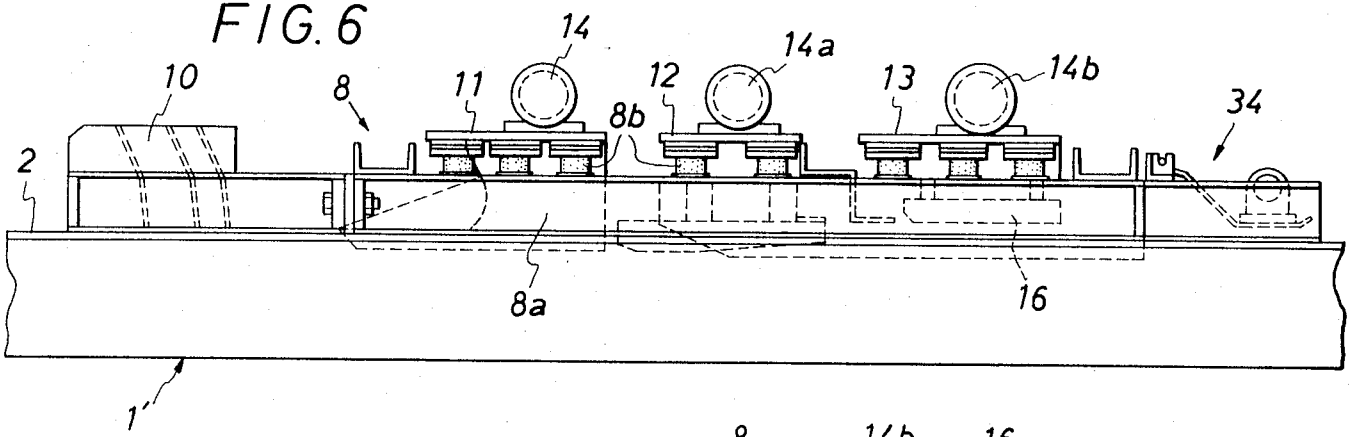
FIG. 6 is an elevation of the sliding upper frame in the embodiment.

In the embodiment of FIG. 6, the upper frame 8 is provided at the foremost part thereof with a scraper 10 adapted to coarsely smooth the stiff-consistency concrete placed in advance on the long lower mold 1'. After the concrete C has been coarsely smoothed by the scraper 10, the height regulating unit 11 passes only the portion of the concrete C which lies under required heights at varying positions on the upper surface of the long lower mold 1'. In the subsequent vibrating unit 12, the vibration guide plates 15, disposed to height positions conforming to the shape of the product called for, vibrate and press the concrete C while advancing it forward. The upper mold 16 of the subsequent shaping unit 13 which is provided with exclusive vibrators finishes the concrete C in a required shape.

Figure 7:
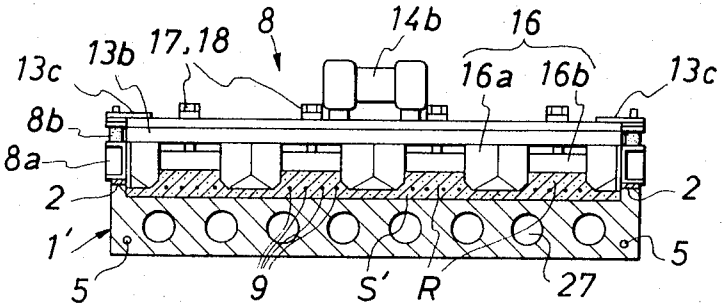
FIG. 7 is a cross section taken along the X—X line shown in FIG. 5.

From the cross section of the product from the present embodiment illustrated in FIG. 7, the product has ribs R of a large thickness arranged in parallel as indicated by S'. In the manufacture of this product, in order for the concrete C to be fed in a greater amount to the positions of the ribs R, the height regulating unit 11 is fitted with forwardly protruding pointed heads **11*a* and the thin-wall portion forming member 16*a* of the upper mold 16 of the shaping unit is similarly fitted with pointed heads so that the concrete C will be pushed toward the ribs R before it reaches the shaping unit 13**.

Figure 10:
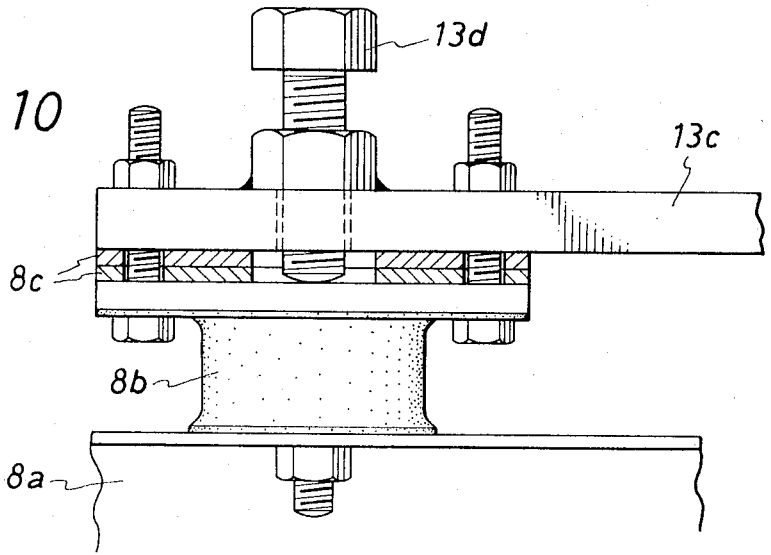
FIG. 10 is a partial view for illustrating the union between the shaping unit and the base frame of the upper frame in the aforementioned embodiment.

The shaping unit 13 has a fitting plate **13*c* which is mounted on the base 8*a* through the medium of a shock-absorbing rubber 8*b* as illustrated in FIG. 10. By turning the adjusting bolt 13*d*, the gap plate 8*c* is moved in the vertical direction relative to the base 8*a*** mainly for the purpose of adjusting the thickness of the thin-walled portion of the product.

In accordance with this invention, the concrete C while moving to the zone underlying the upper mold 16 is not merely guided more toward the ribs R and less toward the thin-walled portion but also given ample preliminary vibration to acquire an enhanced capacity for activity. Thus, the shaping property of the concrete C and the quality of the product are notably improved. The concrete materials obtained by the method of this invention, therefore, have strength favorably comparable with the concrete materials obtained by the stationary molding frame.

On the base **8*a* of the upper frame 8, there are mounted several vibrators adapted to impart vibration to various parts of the concrete C in motion. Since these vibrators operate independently of one another, their vibrations do not cause any mutual interference. Since the shock-absorbing rubber 8*b* prevents the vibrations from being transmitted to the base 8*a*, the vibrations do not impair the accuracy of the long lower mold 1**. The shaped concrete C, accordingly, is not disintegrated even to the slightest extent.

The conventional upper frame for slide forming has simply comprised an upper mold, legs attached to the upper mold and adapted to advance the upper mold on rails, and a vibrator mounted on the upper mold.

In contrast, the upper frame 8 in the apparatus of this invention has the vibrating unit 12 and the height regulating unit 11 before the shaping unit 13 which incorporates the upper mold 16. These units amply fulfill complicated functions to give to the concrete C on the long lower mold 1 a preliminary thickness distribution conforming to the shape of the product, impart powerful vibrations to the concrete C, and then forward the concrete C to the zone underlying the upper mold 16. The upper frame 8, therefore, is provided with the base **8*a* formed of longitudinal girders adapted to slide on the rails 2 of the long lower mold 1 and lateral stationary beams, the vibrating unit beam 12*b* and the shaping unit beam 13*b* provided respectively with vibrators 14*a*, 14*b* and disposed across the forward ends and the rearward ends of the longitudinal girders through the medium of shock-absorbing rubber 8*b*, the vibration guide plates 15 disposed to required heights at varying positions and attached to the aforementioned vibrating unit beam 12*b* so as to vibrate and guide the stiff-consistency concrete placed on the long lower mold 1 in the stated direction, and the upper mold 16 for slide forming attached to the aforementioned shaping unit beam 13*b***.

Where the product has no rib and has a uniform thickness or when the product does not have uniform thickness but has only slight variations in thickness, the height regulating unit 11 may be omitted.

The success of this invention is attributable in one aspect to the fact that the base **8*a* of the upper frame 8, the height regulating unit 11, the vibrating unit 12, and the shaping unit 13 are mutually isolated by the shock-absorbing rubber 8*b* so that vibrations are neither transmitted from one part to another nor allowed to interfere mutually and induce the phenomena of offset or resonance. Although the upper frame 8 as a whole has a weight necessary for the purpose of slide formation of concrete materials, the heaviest base 8*a*** serving as a common bed is not vibrated and the other components are vibrated as suited to their respective functions.

Extremely great force is required to cause internal movement in stiff-consistency concrete at rest. In the presence of vibrations, however, the internal movement can be caused readily. In the handling of concrete, it is important to impart proper vibrations to the concrete. This invention makes effective use of vibrations.

The height regulating unit 11 on the upper frame 8 of this invention serves the purpose of pushing forward the portion of concrete which lies above the required heights. The vibrations generated by this particular unit, therefore, are not required to be very strong. For the purpose of conferring kinetic activity to the concrete, the vibrating unit 12 gives strong vibrations to the vibration guide plates 15 which are relatively light. The shaping unit 13 requires a powerful vibrator capable of vibrating the upper mold 16 which is relatively heavy.

The products obtained by the method of this invention are thin, light, plate-shaped concrete materials. Those incorporating ribs have high flexural strength and, therefore, serve advantageously as frames to be buried in the construction of concrete bridges. In this case, the height of the ribs must be varied in accordance with design calculation.

Figure 8:
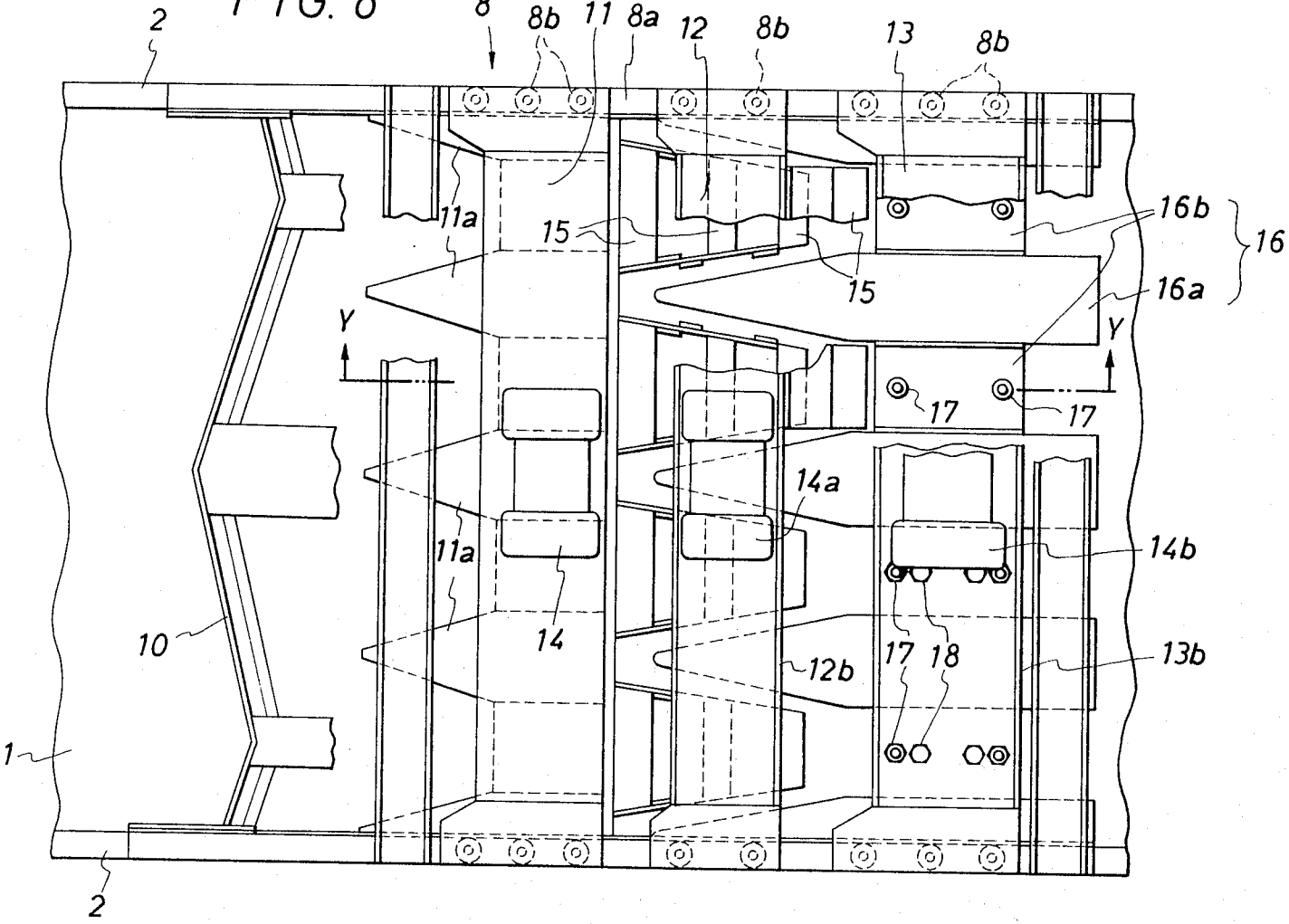
FIG. 8 is a plan view of the upper frame of FIG. 6.
Figure 9:
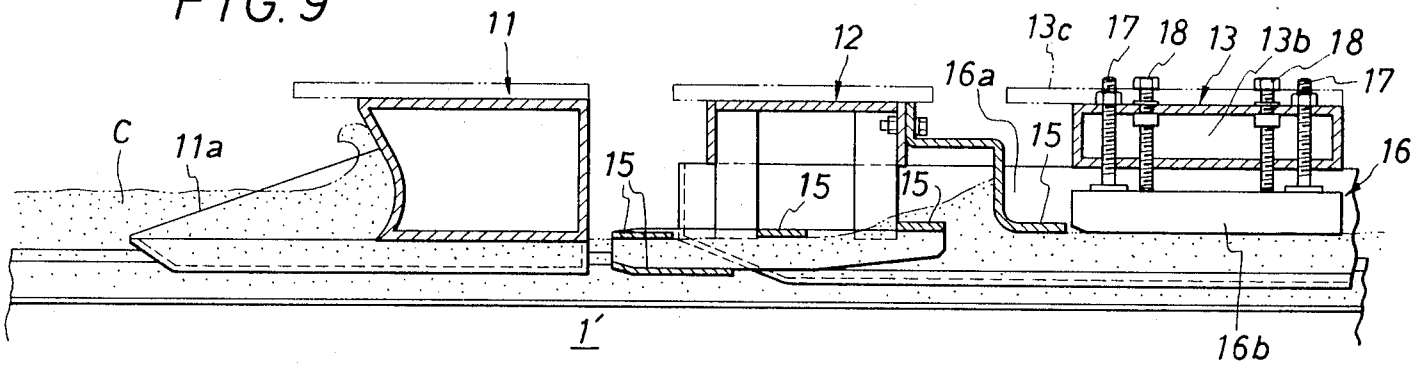
FIG. 9 is a sectional view illustrating the condition in which the upper frame is slid on the concrete to give a shape thereto.

To permit variation in the height of the ribs, the upper mold 16 is separated into a stationary part and a movable part as illustrated in FIGS. 7, 8, and 9. To be specific, the upper mold 16 is composed of a thin-wall part shaping member 16*a* fastened to the lower side of the shaping unit beam 13*b* and possessed of a lower surface for shaping the thin-wall portion of the product being produced and forwardly protruding pointed heads serving to push the unwanted part of the concrete toward the adjacent ribs R and a rib shaping member 16*b* disposed adjacently to the shaping member 16*a* and adapted to be vertically moved or stopped by means of a regulating mechanism attached fast to the shaping unit beam 13*b*.

The regulating mechanism in this embodiment comprises a lifting screw 17 fitted with a regulating nut and having the lower end thereof secured to the upper side of the vertically movable rib shaping member 16*b* and the upper end thereof pierced through the hole bored in the upper side of the shaping unit beam 13*b* and a retention bolt 18 fitted in the nut attached to the aforementioned beam 13*b* and adapted to push down the rib shaping member 16*b* by its lower end. By this regulating mechanism, the varying heights of the ribs R as illustrated in cross section in FIG. 7 can be freely adjusted. It has been generally accepted to date that the ribs R on concrete materials should possess a trapezoidal cross section. This invention has ignored this rule and had made it possible to adjust the height of ribs R by giving the ribs a rectangular cross section. The long lower molds 1, 1' illustrated respectively in FIG. 1 and FIG. 5 often measure over 100 m. In the present embodiment, the upper surface of the long lower mold is divided without affecting the slide formation of concrete materials so that products divided to a prescribed size will be taken out of the mold. This division is effected by means of cross partition members 20 containing grooves 19 or holes for passing prestressing steel wires 9. These partition members 20 have a shape identical to the cross section of the concrete materials desired to be produced and, therefore, can be attached to or detached from the long lower molds 1, 1', moved freely along the length of the mold in accordance with the unit length of concrete materials to be formed, and fastened to the upper surfaces of the long lower molds 1, 1'.

Figure 11:
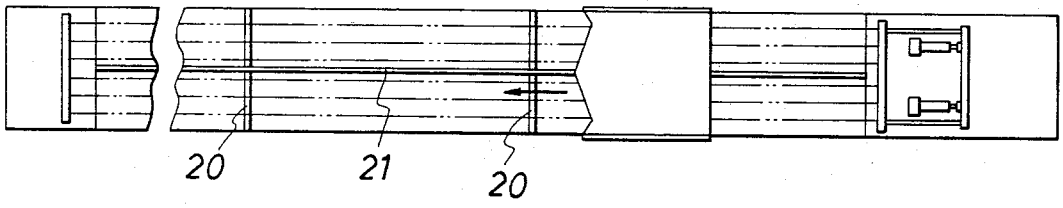
FIG. 11 is a plan view of an embodiment having lateral and longitudinal partitions disposed in the long lower mold.
Figure 12:
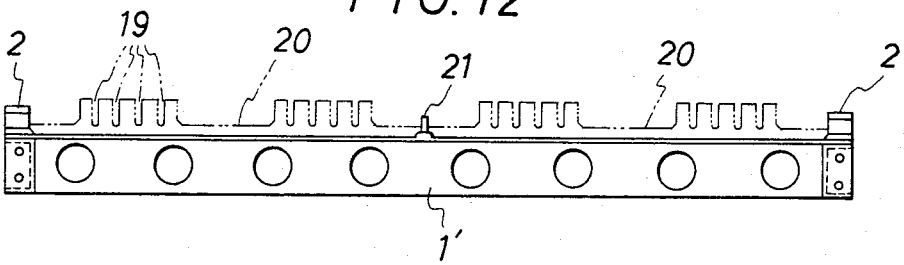
FIG. 12 is an enlarged cross section of the embodiment of FIG. 11.

The embodiment of FIG. 11 is designed, as clearly shown in the elevation of FIG. 12, to form concrete materials in two adjacent rows so that they may be separated along the central line. Thus, this embodiment requires use of a longitudinal partition member 21 along the center line in addition to the cross partition members 20.

Figure 13:
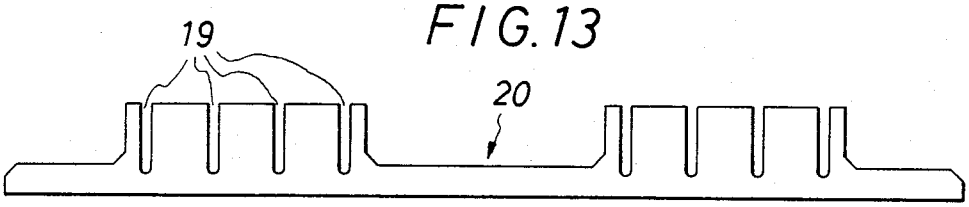
FIG. 13 is an elevation of an embodiment of the aforementioned lateral partition.
Figure 14:
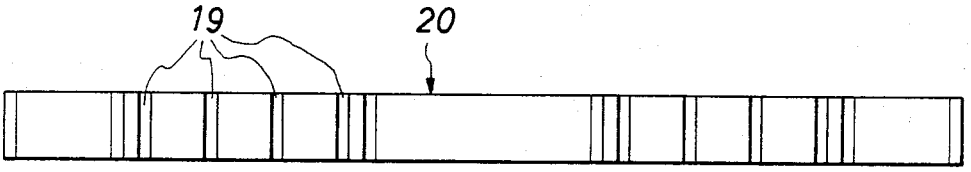
FIG. 14 is a plan view of the embodiment of FIG. 13.
Figure 15:
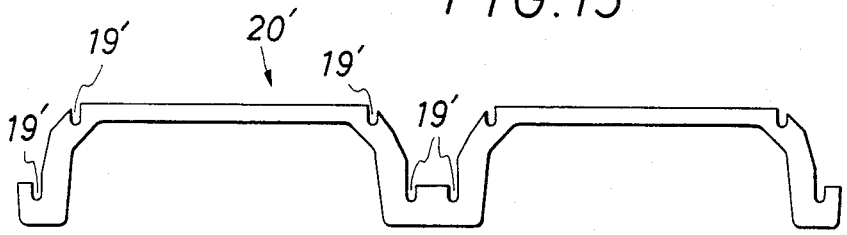
FIG. 15 is an elevation of another embodiment of the lateral partition.
Figure 16:
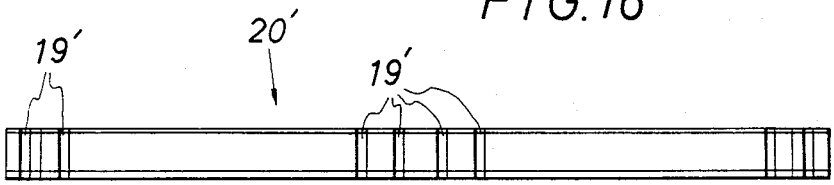
FIG. 16 is a plan view of the embodiment of FIG. 15.
Figure 17:
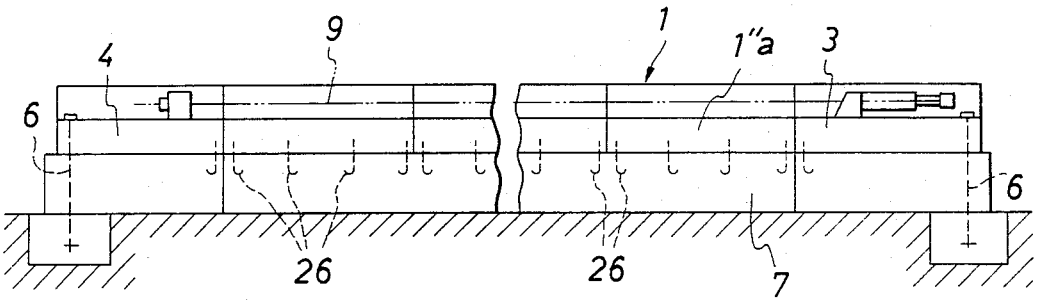
FIG. 17 is an overall view of one embodiment of the long lower mold formed by serially connecting box-shaped stainless steel unit lower molds packed with concrete.
Figure 18:
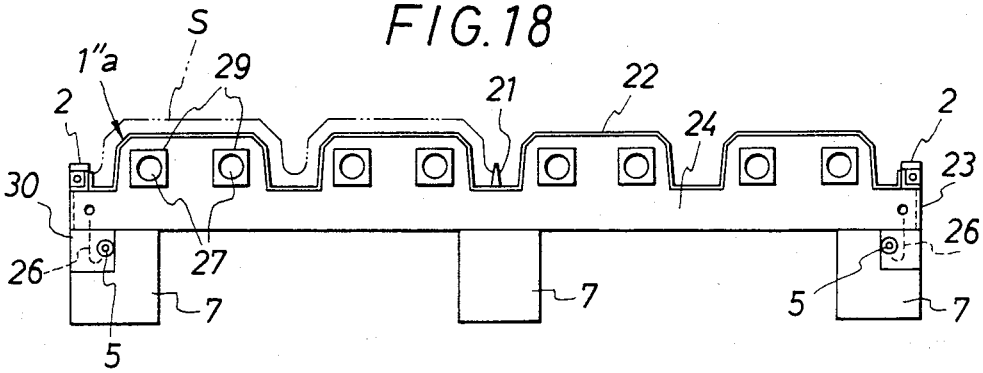
FIG. 18 is a side view of the embodiment of FIG. 17.

The cross partition members 20 illustrated in FIGS. 13, 14 are intended for the formation of concrete materials having a flat lower surface and, therefore, are simple in shape. When the concrete materials to be produced have two adjacent channels in cross section, it becomes necessary to use cross partition members 20' of a construction illustrated in FIG. 15 and FIG. 16. They contain a groove 19' for passing prestressing steel wires.

These partition members 20, 21 are generally fastened to the steel plate on the surface of the long lower mold 1 by suitable means. After the concrete has cured as required, the concrete materials produced in the long lower mold 1 are lifted from the mold. Consequently, the prestressing steel wires 9 are similarly lifted from the grooves 19, 19' of the partition members. The produced concrete materials can be separated from each other simply by cutting the lifted steel wires 9.

Although the unit lower mold 1*a* of the present invention has a relatively simple shape, it is a composite of a very heavy concrete block and a stainless metal plate covering the upper surface of the concrete block. Particularly the unit lower mold for the manufacture of concrete materials having channels or waveforms in their cross section is difficult to fabricate. Preferred embodiments of the unit lower mold which facilitate the fabrication, enjoy high dimensional accuracy, light weight, and ready transportability are illustrated in FIGS. 17–21. The channel type concrete slabs S produced by use of these unit lower molds are similar in shape to the product illustrated in FIG. 2. The unit lower mold 1*a*'' is intended to form these concrete slabs in two adjacent rows. This unit lower mold 1*a*'' is obtained by preparing a box consisting of an upper surface plate 22, side plates 23, and end plates 24 all of steel, placing this box upside down, then placing reinforced concrete on the box, and allowing the concrete to cure. The unit lower mold 1*a*'' is provided with a connecting mechanism capable of tightly joining the end plate 24 thereof to the end plate 24 of the adjoining unit lower mold 1*a*''. A plurality of unit lower molds 1*a*'' thus connected end to end are fastened to the common concrete bases 7 with several anchor bolts 26 used on each side.

Figure 19:
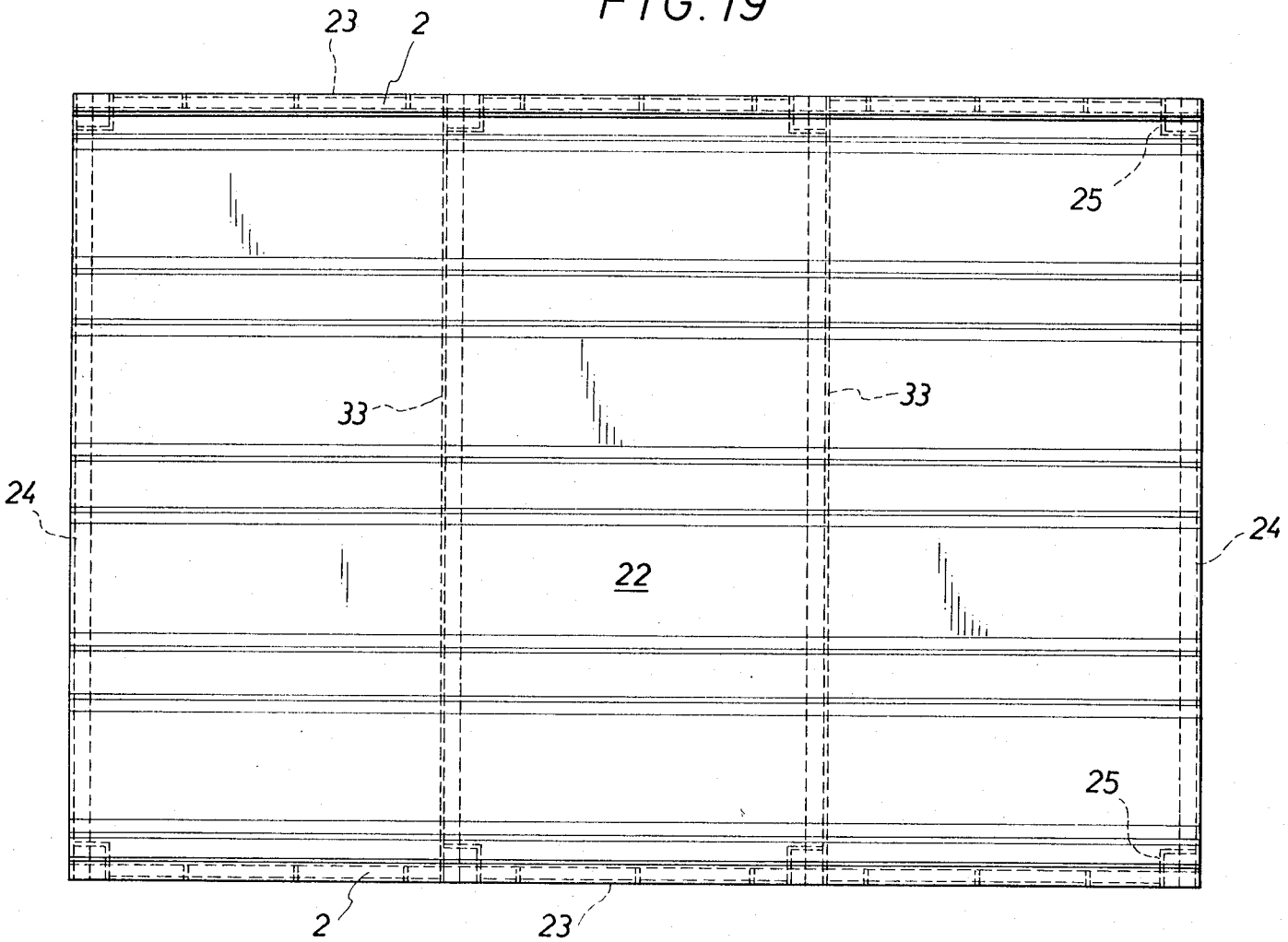
FIG. 19 is a plan view of the unit lower mold of FIG. 17.
Figure 20:
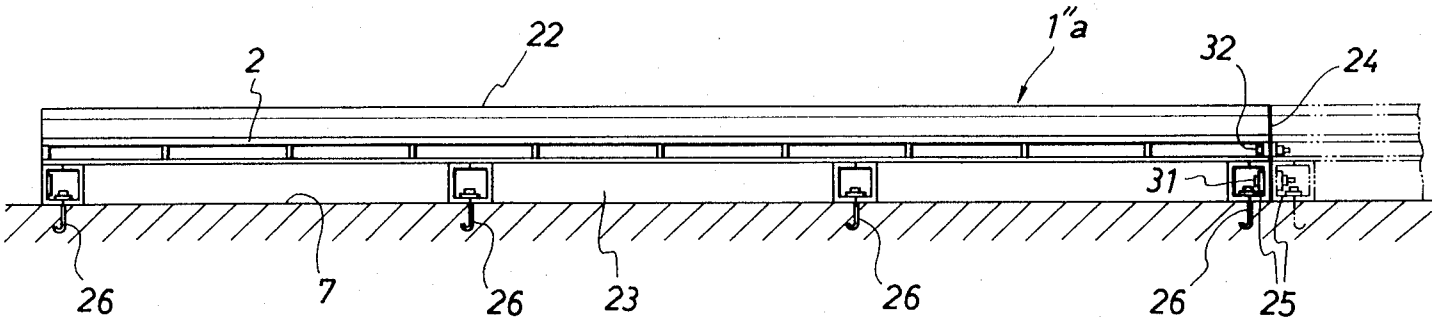
FIG. 20 is an elevation of the unit lower mold.
Figure 21:
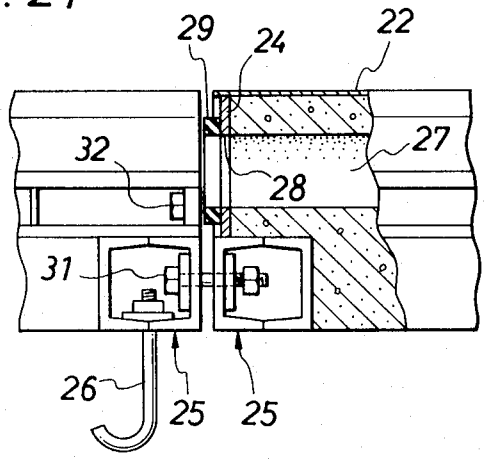
FIG. 21 is an elevation of the joint for connecting two adjacent unit lower molds.

The five faces of the unit lower mold 1*a*'' illustrated in FIGS. 19, 20 other than the bottom face are covered with steel plates. When the enclosure formed of steel plates is transported to a construction site and then filled with reinforced concrete, the unit lower mold 1*a*'' is completed. This practice economizes cost of transportation and proves advantageous. In the unit lower mold 1*a*'' of the present embodiment has two steam vents 27 formed each in the raised portions. At the time the reinforced concrete is placed, steel tubes or resin tubes are passed as cores through the openings 28 formed as steam vents in the end plates 24. These tubes are extracted after the concrete has cured. FIG. 21 illustrates the openings 28 intended as steam vents and improvised as holes for retaining the cores. A soft packing corner plate 29 is fastened to the inner periphery of the opening 28 to preclude otherwise possible leakage of steam through the joint. This packing plate 29 has a size calculated so that when two adjacent unit lower molds 1*a*'' are tightly connected to each other, the packing plate 29 itself is compressed and then the ends of the upper side plates 22 come into intimate contact with each other. The end plates 24 are fastened at positions slightly inward from the ends of the upper plates 22.

The connecting mechanisms 25 formed one each at the four corners where the lateral plates 23 and the edge plates 24 of each unit lower mold 1*a*" meet comprise a small enclosure kept from entry of reinforced concrete and a connecting bolt 31 and a nut and a washer therefor disposed in the small enclosure and adapted to be joined. By these connecting mechanisms 25, the opposed lower parts of the end plates are tied to each other. Similar enclosures are formed one each near the head portions of the anchor bolts 26.

In the lateral grooves 30 of the parallel concrete bases 7 which admit the lower ends of the anchor bolts 26, copper wires 5 similar to the copper wires used for fastening up the combination long lower mold and pretension bench 1 are laid throughout the entire length, stretched, and covered with concrete.

When adjacent unit lower molds 1*a*" are joined to each other by the connecting mechanisms 25, the respective ends of adjacent rails 2 are joined by connecting their end brackets with bolts 32. In the present embodiment, as illustrated in FIG. 19, since the opposite edge plates 24 are separated by 3 meters, two angle bars 33 are laid at suitable intervals between the edge plates 24 so as to enhance the rigidity.

It has been described that homogeneous concrete products are obtained by the slide forming method of this invention. This statement means that the concrete products by this invention have homogeneous quality as compared with the products obtained by the conventional slide forming method which resorts solely to the vibration of the upper mold. No matter how thoroughly a mass of concrete may be shaken in advance, there inevitably arises a difference in density between the upper surface region and the lower surface region of the produced concrete block, for example. To minimize this difference in density, therefore, this invention applies vibration and pressure to the upper surface of such concrete block by a finishing unit 34 after passage of the upper mold.

Figure 5:
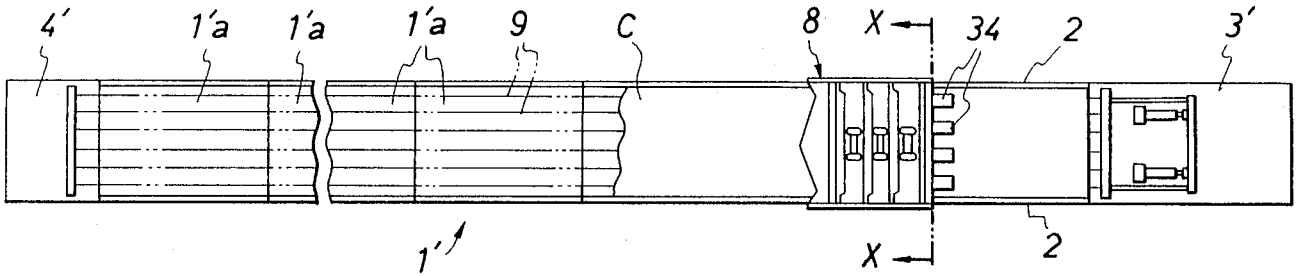
FIG. 5 is an overall plan view of one embodiment of this invention.
Figure 22:
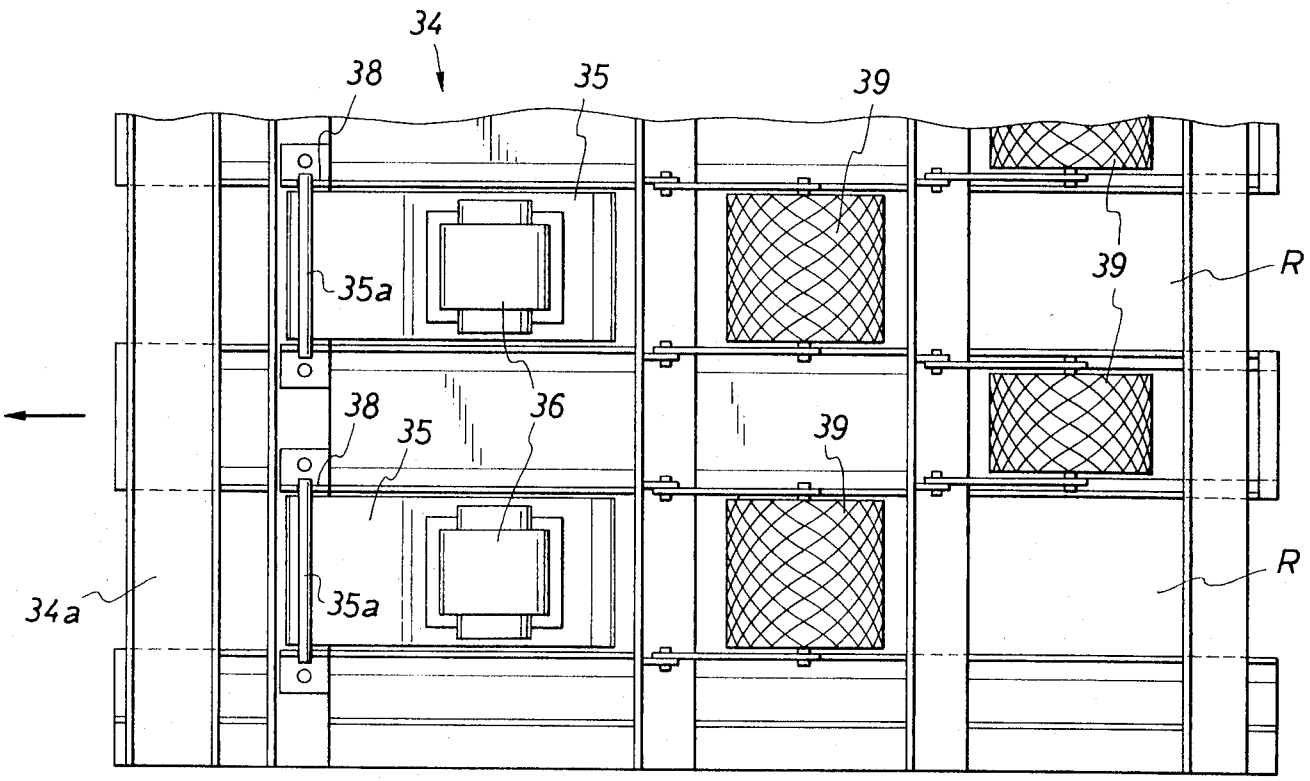
FIG. 22 is a plan view of the finishing unit which is connected to the rear end of the slide upper frame.
Figure 23:
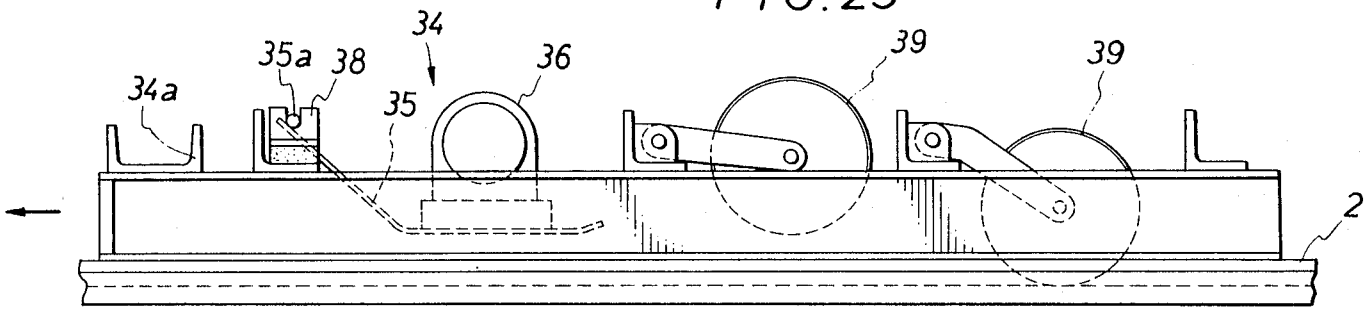
FIG. 23 is an elevation of the finishing unit.
Figure 24:
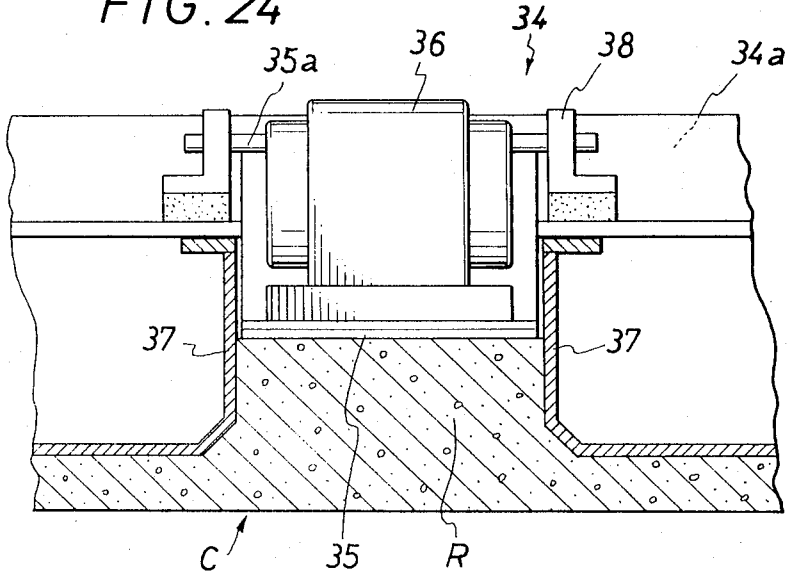
FIG. 24 is a partial side elevation of the finishing unit.

This operation of the finishing unit 34, though depicted also in FIGS. 5 and 6, will be described below with reference to the diagrams of FIGS. 22–24. The finishing unit 34 is provided with a depressing plate 35 vertically floatably connected to and dragged by the rear part of the base frame 8*a* of the upper frame 8 and adapted to press down and advance on the top surface of the rib R of the formed concrete, combination vibrating and depressing means, namely, vibrators 36 for imparting vertical vibration and pressure selectively to the depressing plate 35, and rib-clamping plates 37 fastened to the rear part of the base frame 8*a* and adapted to keep the opposite lateral surfaces of the rib R at a stated distance.

In the illustrated embodiment, bearings 38, formed by cutting as many U-shaped grooves in vertical plates as the number of ribs R, are opposed to each other on the upper surface of the machine frame 34*a* of the finishing unit 34, so as to support in position a horizontal vibration shaft 35*a* at the upper end of the depressing plate 35. The vibrator 36 which is directly fastened to the depressing plate 35 imparts vertical vibrations to the depressing plate 35 and, at the same time, exerts its own weight to depress the top surface of the rib R. Thus, it serves to apply both vibration and downward pressing force.

In consequence of the operation of the finishing unit 34, the upper surface region of the rib R which has had relatively low density is compacted. It is, therefore, desirable that the size of the upper mold should be designed with due allowance for the amount of depression to be caused by the depressing plate 35. The vibration and pressure thus applied to the top surface of the rib R cannot cause the rib R to bulge along the lateral edges because the opposite lateral edges of the rib R are held back by the clamping plates 37.

In the present embodiment, to permit formation of flush frames for concrete bridges, a meshed pattern (alternating rises and falls of surface) is imparted to the upper surface which suits the cast-in-place concrete. Specifically, a roller 39 having a meshed surface or corrugated surface is passed on the top surface of the rib R and on the upper surface of the thin-walled portion so that the roller, by its own weight, imparts a meshed pattern to the surface.

Figure 25:
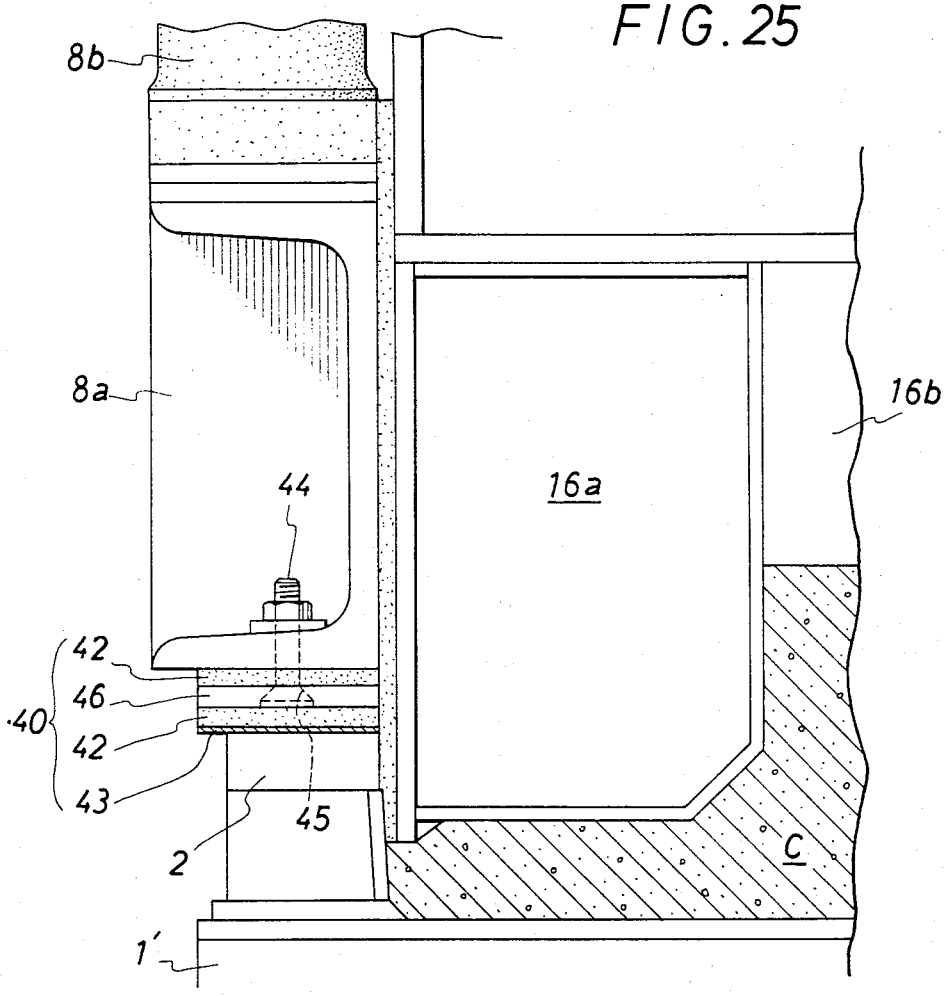
FIG. 25 is a cross-sectional view of a buffer belt material interchangeably attached to the lower surface of the slide base frame.

The upper frame of the slide forming apparatus advances on the mass of concrete laid on the lower mold while imparting vigorous vibration to the concrete. The violent vibration often causes trouble to the leg surfaces of the base frame 8*a* which slide on the rails 2. An improvement offered to overcome this trouble is illustrated in FIG. 25. This improvement is effected by fastening shock-absorbing strips 40 upwardly with screws to the lower sides of the entire lengths of the base frame 8*a* of the sliding upper frame 8 which come into contact with the rails 2. The shock-absorbing strips each comprises a strip of steel plate 46, a shock-absorbing rubber plate 42 applied to the lower side of the steel plate 46, a wear-resistant sheet 43 applied fast to the lower side of the rubber plate 42, and countersinking screws 44 driven into countersunk holes 45 formed in the strip of steel plate 46. In the present embodiment, rubber plates 42 are attached fast also to the upper surfaces of the strips of steel plate 46. The screws 44 are passed through the holes in the channel steel bar and tightened with nuts through the medium of spring washers.

The aforementioned shock-absorbing strips 40 of a composite construction having the countersinking screws 44 fastened to the steel plate strips 46 can be attached to and detached from the base frame 8*a* very easily as compared with the conventional version using rubber belts. Moreover, they enjoy notably improved durability because the steel plates 46 serves to prevent the rubber plates 42 from irregular deformation and the rubber plates 42 to prevent the sheets 43 from local wear.

Now, the new curing method which forms one of the salient features of this invention will be described below. The unit lower molds 1*a*, 1*a*' illustrated in FIGS. 3, 4 have curing steam holes 27 perforated therethrough in the longitudinal direction. When a required plurality of such unit lower molds 1*a*, 1*a*' are joined end to end through the medium of packing plates attached fast in advance to one end of each of such unit lower molds to complete a long lower mold 1', several continuous steam holes 27 are formed throughout the entire length of the completed long lower mold.

Figure 26:
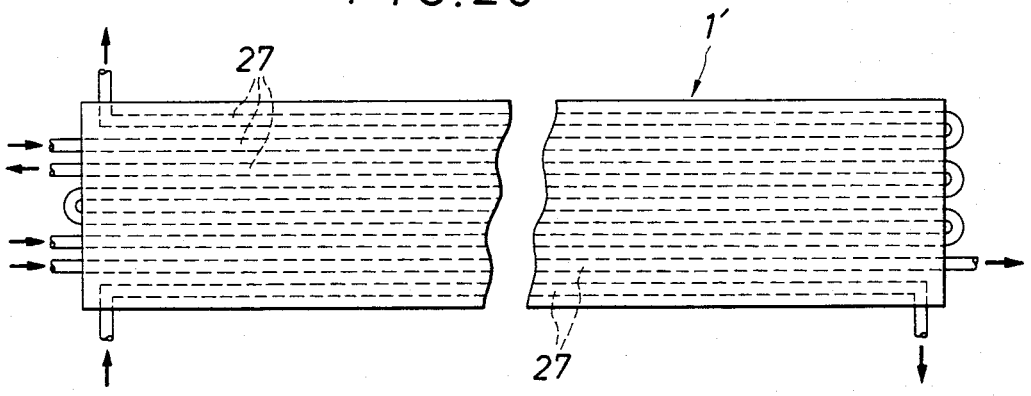
FIG. 26 is a plan view illustrating a typical manner of passing steam to the steam orifices of the long lower mold.

Passage of steam to the several steam holes 27 can be effected by any desired method. Varying methods of passing the steam are shown by way of illustration in FIG. 26. Of course, it is important that the steam should be passed so that the whole long lower mold 1' may be evenly heated.

The new curing method contemplated by this invention which effects the curing of the mass of concrete held in its forming position by efficient use of the continuous steam holes 27 distributed through the long lower mold 1' can be carried out most efficiently as follows.

It is not until after completion of the slide forming of the concrete that the passage of steam to the steam holes 27 in the long lower mold 1' is to be started. The stiff-consistency concrete is poured and laid on the upper surface of the lower mold 1' while heated steam is being passed through the steam holes 27. Then, the shaping of the placed concrete is effected by advancing the upper sliding frame 8 on the concrete. Immediately after this shaping, a cover sheet is placed on the shaped concrete in the mold.

After the shaped concrete has reached the optimum temperature, the passage of the steam to the aforementioned steam holes 27 is discontinued. After the concrete is left standing for a prescribed time, the cover sheet is removed and the cured concrete is removed from the lower mold 1' and conveyed to a storage yard.

Since the rise and fall of temperature of the long lower mold 1' made of concrete proceed gradually, this new curing method permits ideal control of the curing temperature. The preparatory warming of the long lower mold 1' in advance of the slide forming work brings about an effect similar to the effect of the hot concrete method. This new curing method obviates the necessity for providing an extra place for curing large concrete products. The otherwise necessary work of moving the shaped concrete in conjunction with its molding frame to the curing place is no longer required.

Now, a prestressed concrete slab incorporating a centrally raised rib which is easily obtained by the present invention and a method for the manufacture of this slab will be described below with reference to FIGS. 27–32. The concrete slab comprises a plate-shaped thin-walled portion having a metal gauze 41 embedded therein throughout the entire area thereof, ribs R raised in the form of ridges throughout the entire length of the thin-walled portion, and prestressing steel wires 9 laid near the roots of the ribs R. The ribs R have the largest height along the middle of the entire length and gradually decreasing height toward the opposite edges.

Figure 27:
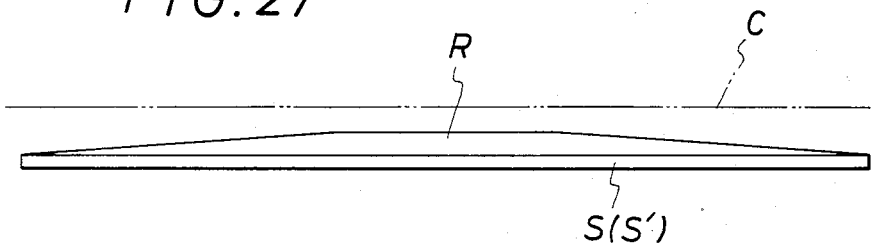
FIG. 27 is an elevation of one typical concrete slab (for embedding in a concrete bridge) having ribs raised in the central portion.
Figure 31:
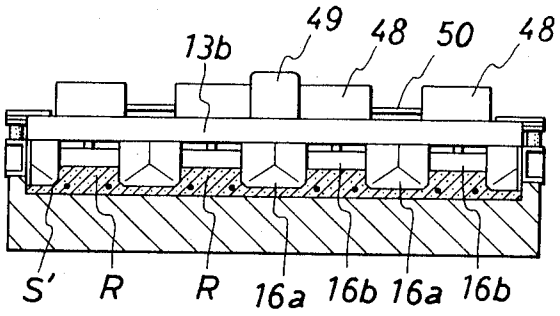
FIG. 31 is a front view of an upper frame shaping unit provided with a device for automatically elevating the upper ribs thereby permitting slide forming of concrete slabs having ribs raised in the central portion thereof.

FIG. 27 is a side view of one concrete slab (flush mold for concrete bridge) of this invention which has a cross section resembling the cross section of S' in FIG. 31. The chain line C indicates the height to which concrete is cast in place on the concrete slab as the flush mold. It is noted that the height of the rib R (R') gradually decreases from the center to the both edges.

Figure 28:
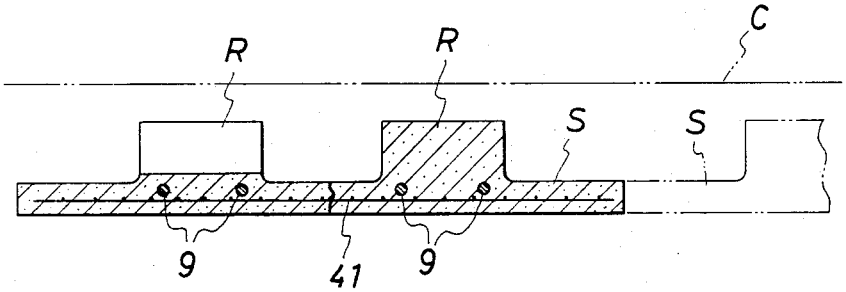
FIG. 28 is a cross-sectional view of the concrete slab.

The lefthand half of the cross section of FIG. 28 represents the end portion of the rib R having a small height and the righthand half of the cross section represents the middle portion of the rib R having the greatest height.

Figure 29:
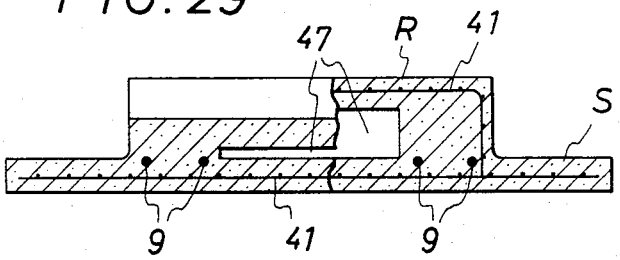
FIG. 29 is a cross-sectional view of a typical concrete slab having hollow ribs.

FIG. 29 illustrates in cross section an end portion of a rib R and a central portion of another rib R which both have a hollow interior. From this diagram, it is noted that the weight of the rib R does not increase in proportion as the height of the rib R is increased. The hollow portion 47 has its height varied in proportion to the height of the rib R. The portion of concrete embracing the hollow portion 47 is reinforced with a metal gauze 41 embedded therein.

Figure 30:
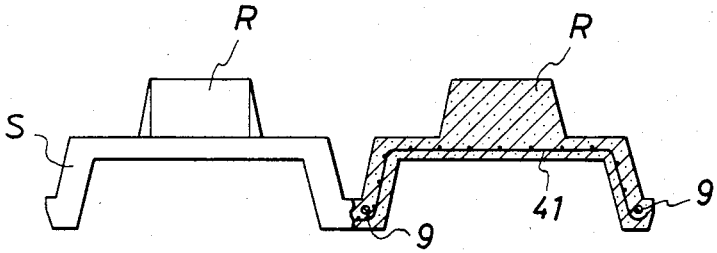
FIG. 30 is a partial cross-sectional view of a typical concrete slab of the double-channel type having ribs raised in the central portion thereof.

FIG. 30 illustrates an embodiment in which ribs R raised most at the center similarly to the ribs R of FIG. 27 are added to an ordinary channel type concrete slab S.

The manufacture of a prestressed concrete slab containing such centrally raised ribs is effected by vertically reciprocating the rib portion **16*b* of the upper sliding mold 16 illustrated in FIGS. 7, 9 and described with reference to the diagrams of FIGS. 7, 9. Since the continuous reciprocation cannot be conveniently effected with the lifting screw 17 and the retaining bolt 18 of the aforementioned embodiment, the rib portion 16*b* may be adapted to be automatically controlled as illustrated in FIG. 31. Specifically, the automatic control is accomplished by providing a vertical drive mechanism 48 directly above each of the rib portions 16*b* of the beam 13*b* of the shaping unit and causing the drive motor 49 disposed in the middle to drive all at once the vertical drive mechanisms through the medium of a transmission shaft 50**.

Figure 32:
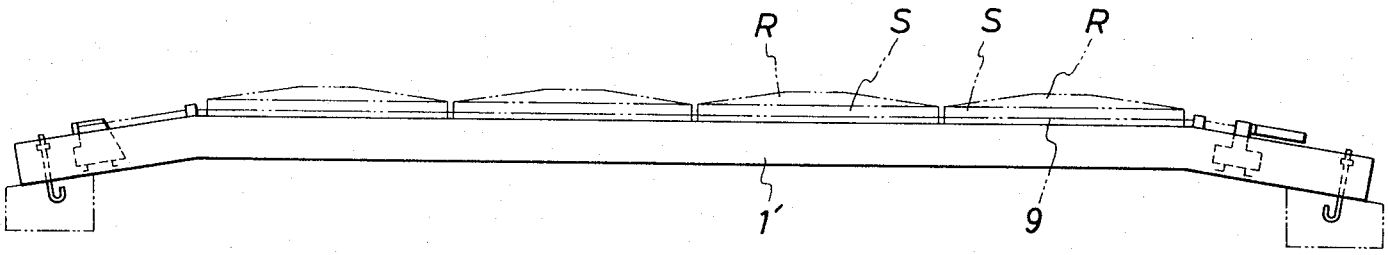
FIG. 32 is an explanatory diagram for illustrating the continuous formation of a plurality of concrete slabs having ribs raised in the central portion.

FIG. 32 illustrates an embodiment in which four relatively short concrete slabs S are produced as serially arranged in the long lower mold 1' set.

The prestressed concrete slab has its strength enhanced enough to endure the flexural load applied thereto because the height of the ribs R is greatest at the center and is gradually decreased toward the opposite ends and further because prestressing steel wires are embedded near the roots of the ribs R. The effects of the regulated height of ribs and the insertion of steel wires are plain from the standpoint of dynamics.

Obviously, many modifications and variations of the present invention are possible in light of the foregoing techings. It is therefore to be understood that within the scope of the appended claims, the present invention may be practiced otherwise than as specifically described herein.

What is claimed is:

1. A slide forming apparatus for forming a concrete product containing one or more ribs extending in the longitudinal direction of said product, comprising:

an elongated lower mold;

an upper frame member slideably disposed upon said lower mold;

mold means disposed upon said upper frame member for slide forming said concrete product, said mold means including first means for forming at least one relatively thickened rib portion of said concrete product, and second means for forming at least one relatively thin portion of said concrete product; and means for automatically controlling the elevational adjustment of said first means for forming said at least one rib portion of said concrete product as said upper frame member and said mold means are slideably moved upon said lower mold during formation of said concrete product so as to selectively determine the thickness of said at least one rib portion of said concrete product at various locations along the longitudinal extent of said at least one rib portion of said concrete product.

2. A slide forming apparatus as set forth in claim 1, wherein:

said at least one rib portion of said concrete product has a thickness dimension which is greater at the longitudinally central portion thereof than at the longitudinal end portions thereof.

3. A slide forming apparatus for forming a concrete product, comprising:

an elongated base;

an elongated lower mold upon the upper surface of which concrete is adapted to be disposed for formation of said concrete product;

an upper mold slideably disposed atop said elongated lower mold;

said elongated lower mold being defined by means of a plurality of inverted lower mold units each of which includes an upper plate, two dependent side plates, and two dependent end plates, and cured concrete disposed beneath said upper plate and between said pairs of end and side plates;

means for connecting together an end plate of one of said elongated lower mold units to the end plate of another one of said elongated lower mold units; and means for connecting together each of said lower mold units to said elongated base.

4. A slide forming apparatus for forming a concrete product, comprising:

an elongated lower mold upon the upper surface of which concrete is adapted to be disposed for formation of said concrete product;

an upper mold slideably disposed atop said elongated lower mold;

said elongated lower mold being defined by means of a plurality of inverted lower mold units each of which includes an upper plate, a pair of dependent side plates, a pair of dependent end plates, and cured concrete disposed beneath said upper plate and between said pairs of end side plates;

means defining longitudinally extending curing steam conduits within said lower mold cured concrete and said end plates;

means for connecting together an end plate of one of said elongated lower mold units to the end plate of another one of said elongated lower mold units; and packing means interposed between said connected end plates of said lower mold units for sealing said steam conduits, against steam leakage, respectively defined within said lower mold units.

5. A slide forming apparatus for forming s concrete product containing one or more ribs extending in the longitudinal direction of said product, comprising:

an elongated lower mold upon the upper surface of which concrete is adapted to be disposed for formation of said concrete product;

an upper frame member slideably disposed upon said lower mold;

mold means disposed upon said upper frame member for slide forming said concrete product, said mold means including first means for forming at least one relatively thickened rib portion of said concrete product, and second means for forming at least one relatively thin portion of said concrete product, said at least one relatively thickened rib portion of said concrete product including sidewalls extending upwardly form said at least one relatively thin portion of said concrete product, and an upper surface connecting said sidewalls together;

a depressing plate floatably suspended from said upper frame member for engagement with said upper surface of said at least one relatively thickened rib portion of said concrete product;

vibration means secured to said depressing plate for imparting vibrational and pressure-weight forces to said upper surface of said at least one relatively thickened rib portion of said concrete product; and plate means secured to said upper frame member for engaging said sidewalls of said at least one relatively thickened rib portion of said concrete product so as to laterally define the width of said at least one relatively thickened rib portion of said concrete product and prevent the lateral or transverse expansion of said at least one relatively thickened rib portion of said concrete product under said vibrational and pressure-weight forces impressed upon said upper surface of said at least one relatively thickened rib portion of said concrete product by said vibration means.

6. A slide forming apparatus for forming a concrete product, comprising:

an elongated lower mold upon the upper surface of which concrete is adapted to be disposed for formation of said concrete product;

an upper frame member slideably disposed upon said lower mold;

vibration-inducing means mounted upon said upper frame member for imprating vibrations to said concrete disposed upon said lower mold; and shock absorbing means secured to said upper frame member for absorbing said vibrations of said vibration-inducing means and facilitating the slideable movement of said upper frame member upon said lower mold under said vitrational conditions, said shock absorbing means including a strip of steel plate secured to said upper frame member, a shock-absorbing rubber plate secured to the undersurface of said steel plate, and a wear-resistant plate secured to the undersurface of said shock-absorbing for slideable engagement upon said lower mold.

7. Slide forming apparatus as set forth in claim 6, further comprising:

a shock-absorbing rubber plate secured to the upper surface of said steel plate so as to be interposed between said steel plate and said upper frame member.

8. A slide forming apparatus for forming a concrete product containing one or more ribs extending in the logitudinal direction of said product, comprising:

an elongated lower mold;

an upper frame member slideably disposed upon said lower mold;

mold means disposed upon said upper frame member for slide forming said concrete product, said mold means including first means for forming at least one relatively thickened rib portion of said concrete product, and second means for forming at least one relatively thin portion of said concrete product;

first means for elevationally adjusting said first means for forming said at least one rib portion of said concrete product so as to selectively predetermine the thickness of said at least one rib portion of said concrete product produced by said slide forming apparatus; and second means, independent of said first means, for elevationally adjusting said second means for forming said at least one relatively thin portion of said concrete product so as to selectively predetermine the thickness of said at least one relatively thin portion of said concrete product produced by said slide forming apparatus.

9. Apparatus for slide forming a concrete product containing one or more ribs extending in the longitudinal direction of said product, comprising:

an elongated lower mold;

an upper frame member slideably disposed upon said lower mold;

first means disposed upon the forward end of said upper frame member for regulating the height of said concrete disposed atop said lower mold by removing excess concrete from said lower mold, and for preliminarily pre-shaping said concrete disposed upon said lower mold toward a predetermined configuration of said concrete product containing at least one longitudinally extending rib portion as will finally be determined by means of an upper mold of said apparatus, said first means including first vibration-inducing means for imparting requisite activity within said concrete disposed upon said lower mold so as to facilitate the movement of said concrete material disposed upon said lower mold and thereby achieve said height regulation and pre-shaping of said concrete;

second means, disposed rearwardly of said first means upon said upper frame member, including second vibration-inducing means, for vibrationally compacting and densifying said concrete disposed atop said lower mold whereby said concrete will tend to fill said upper and lower mold portions of said apparatus with a predetermined degree of densification;

third means, including said upper mold for cooperating with said lower mold in forming said concrete product to said predetermined configuration, disposed rearwardly of said second means upon said upper frame member for finally shaping said concrete product, including said at least one rib portion, so as to achieve said predetermined configuration, and further including third vibration-inducing means for achieving said finally shaped concrete product with a requisite degree of densification; each of said first, second, and third means being secured to said upper frame member independently of said other two means; and shock absorbing means interposed between each of said first, second, and third means and said upper frame member for isolating each of said first, second, and third means from each other and said upper frame member whereby the vibrations induced within said concrete product by any one of said first, second, and third vibration-inducing means will be absorbed by said shock-absorbing means and not be transmitted to said upper frame member or to any other one of said first, second, and third means so as to effectively prevent the development of any vibrational interference or resonance between said first, second, and third means.

10. Apparatus as set forth in claim 9, wherein:

said first means for pre-shaping said concrete includes pointed head structure for pushing excess concrete material toward the portion of said mold within which said at least one rib Portion of said concrete product will be formed.

11. Apparatus as set forth in claim 10, wherein:

said third means for finally shaping said concrete product includes pointed head structure corresponding to said pointed head structure of said first means for finally shaping said at least one rib portion of said concrete product.

* * * * *